US007316294B2

(12) United States Patent
Mustalahti et al.

(10) Patent No.: US 7,316,294 B2
(45) **Date of Patent: *Jan. 8, 2008**

(54) ELEVATOR

(75) Inventors: Jorma Mustalahti, Hyvinkää (FI); Esko Aulanko, Kerava (FI)

(73) Assignee: Kone Corporation, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 11/350,041

(22) Filed: Feb. 9, 2006

(65) Prior Publication Data

US 2006/0191747 A1 Aug. 31, 2006

Related U.S. Application Data

(63) Continuation of application No. PCT/FI2004/000353, filed on Jun. 8, 2004.

(30) Foreign Application Priority Data

Aug. 12, 2003 (FI) ..... 20031148

(51) Int. Cl.
*B66B 9/00* (2006.01)

(52) U.S. Cl. ..... 187/249

(58) Field of Classification Search ..... 187/249
See application file for complete search history.

(56) References Cited

U.S. PATENT DOCUMENTS 1,914,128 A * 6/1933 James et al. ..... 187/249
1,973,920 A * 9/1934 Wilson ..... 187/249
5,526,901 A * 6/1996 Salmon ..... 187/249

FOREIGN PATENT DOCUMENTS

| | | | |
|---|---|---|---|
| EP | 1 357 075 A1 | * | 10/2003 |
| JP | 4-80188 | * | 3/1992 |
| JP | 11-228058 | * | 8/1999 |
| JP | 2000-309482 | * | 11/2000 |
| JP | 2001-226048 | * | 8/2001 |
| JP | 2002-255460 | * | 9/2002 |
| WO | 02/38482 | * | 5/2002 |

* cited by examiner

*Primary Examiner*—Thomas J. Brahan
(74) *Attorney, Agent, or Firm*—Birch, Stewart, Kolasch & Birch, LLP

(57) ABSTRACT

The invention relates to an elevator and a method for adjusting the inter-car distance in an elevator which comprises two or more elevator cars coupled to each other so as to be movable together in an elevator shaft, and in which these elevator cars are at least partly suspended by means of a common set of hoisting ropes (2). The vertical inter-car distance between the elevator cars (6 and 7) is adjusted by moving at least one of the elevator cars (6 or 7) in relation to at least one other elevator car (6 or 7) by pulling the elevator car to be moved upwards and lowering the elevator car to be moved downwards by means of at least one adjusting rope (13).

16 Claims, 4 Drawing Sheets

ELEVATOR

This application is a Continuation of co-pending PCT International Application No. PCT/FI2004/000353 filed on Jun. 8, 2004, which designated the United States, and on which priority is claimed under 35 U.S.C. § 120. This application also claims priority under 35 U.S.C. § 119(a) on patent application Ser. No(s). 20031148 filed in Finland on Aug. 12, 2003. The entire contents of each of the above documents is hereby incorporated by reference.

BACKGROUND OF THE INVENTION

Field of the Invention

The present invention relates to a method and to an apparatus for adjusting the distance between the cars of an elevator and to an elevator.

The invention relates in particular to adjustment of the car distance between the elevator cars of a so-called double-deck elevator in which the cars are placed one above the other in the same car frame. In this context, adjustment of inter-car distance is also termed adjustment of inter-floor distance.

DESCRIPTION OF THE BACKGROUND

Elevators having two elevator cars placed one above the other in the same car frame are used e.g. in tall buildings to increase the transport capacity. Such multi-deck elevators, preferably double-deck elevators, can serve e.g. as collector elevators.

Traditionally, double-deck elevators have fixed inter-car distances, as described e.g. in the old German patent specification DE1113293. However, double-deck elevators with a fixed inter-car distance involve the problem that in many buildings the distances between floors are not equal. Often, especially in modern tall buildings, the entrance lobby is higher than the other stories. Likewise, the building may have other special stories of varying height. In addition, in tall buildings the tolerances may be repeated, and thus the story heights of upper and lower floors may be different. In such buildings, in double-deck elevator solutions with a fixed inter-car distance only one of the cars can be driven exactly to the correct position while the other one remains above or below the floor level at a distance corresponding to the difference.

To solve the above-mentioned problem, double-deck elevators have been developed in which the vertical distance between the elevator cars mounted in the same car frame, i.e. the inter-floor distance can be adjusted. European patent application no. EP1074503 proposes a number of solutions to address the above-mentioned problem. FIG. 1 of the aforesaid publication illustrates a solution wherein the elevator cars in the car frame are raised or lowered in relation to each other and the car frame by means of a motor or equivalent provided in the car frame.

Similarly, FIG. 2 illustrates another prior-art solution, which corresponds to e.g. U.S. Pat. No. 5,907,136. In this known solution, the elevator cars in the car frame are raised or lowered in relation to each other and the car frame by means of a jack and a scissors mechanism provided in the car frame. In addition, the car frame comprises an intermediate beam, which carries the fixing point of the joint of the scissors mechanism. The upper car is raised by means of a hoisting device provided in the car frame, such as a motor or by rotating lifting screws or by means of power cylinders.

When the upper car is moving in one direction, the lower car, driven by the scissors mechanism, is simultaneously moving in the other direction.

The aforesaid EP specification EP1074503 itself proposes two elevator cars placed one above the other in the car frame and coupled to be moved by thick screw bars in relation to each other and the car frame. The screw bar moving the upper car and the screw bar moving the lower car have threads of opposite pitch, and consequently the elevator cars move in opposite directions when the screw bars are rotated. The drive motor of the screw bars is placed in the upper part of the car frame.

Although the prior-art solutions referred to above do overcome the aforesaid drawback caused by a fixed inter-car distance in double-deck elevators, these solutions are not without problems. All the above-mentioned solutions are complicated in structure and involve unnecessary additional weight in the car frame. Moreover, they take up space that would be needed for other equipment in the car frame. A further problem is that the drive means, such as motors and power cylinders in the car frame require operating energy, which has to be supplied to the moving car frame from outside. For example, an electric motor requires separate supply of power via the car cable to the car frame. Likewise, the power cylinders or equivalent need their own power supply. An additional problem is that the devices moving with the car frame are difficult to adjust and maintain because these operations have to be performed in the elevator shaft on the top of the car frame or otherwise in connection with the car frame.

The solution of the present invention aims at eliminating the above-mentioned drawbacks and providing a reliable and economical elevator and a method for adjusting the inter-car distance of an elevator, in which solution at least one of the elevator cars placed one above the other in the car frame can be moved in relation to at least one other elevator car. A further aim is to create a solution for adjustment of the said inter-car distance that permits easy adjustment and maintenance.

The method of the invention, and the elevator of the invention are presented in the description part of this application. application. The inventive content of the present application can also be defined in other ways than is described below. The inventive content may also consist of several separate inventions, especially if the invention is considered in the light of expressions or implicit sub-tasks or in view of advantages or sets of advantages achieved. In this case, some of the attributes contained in the claims below may be superfluous in respect of separate inventive concepts.

The solution of the invention has the advantage of simple and clear structure. A further advantage is that the devices needed for adjustment of the car distance between the elevator cars are disposed in a fixed place either in the machine room or e.g. on the bottom of the elevator shaft procedure in some other appropriate place in the building, such as e.g. in the upper part of the elevator shaft. Thus, the adjusting devices are easily accessible and therefore easy to adjust and maintain. Another advantage is that the car frame need not be provided with a supply of electricity to the devices used to adjust the inter-car distance. Due to easy and good adjustability, the elevator cars of the elevator, preferably a double-deck elevator, can be driven accurately to their respective floor levels regardless of things like different loads of the elevator cars, because load compensation can be taken into account in the adjusting device. The equipment used in the elevator of the invention for adjustment of the inter-car distance can also be implemented as a control mechanism in the case of an elevator machine based on frictional drive, in which case a lower energy consumption is achieved as an additional advantage as compared with a solution implemented using a machine with drum drive. In addition, in an elevator implemented using frictional drive, the size of the machines used is reduced and it is possible to use standard elevator components in the car distance adjusting mechanism. The size of the main hoisting machine of the elevator can also be reduced when an adjusting mechanism implemented with frictional drive is used, because, due to the simpler implementation of the adjusting equipment, it is possible to use lighter elevator components in the cars and car frame and in the system moving them. Besides, there is no need to build any heavy hoisting equipment arrangements for the adjusting equipment.

In the method of the invention for adjusting the inter-car distance in an elevator comprising two or more elevator cars coupled to each other so as to move together in an elevator shaft, and in which elevator these elevator cars are at least partly supported by a common set of hoisting ropes. The vertical distance between the elevator cars is adjusted by moving at least one of the elevator cars in relation to at least one other elevator car by pulling the elevator car to be moved upwards and lowering the elevator car to be moved downwards by means of at least one adjusting rope. In addition, in another method according to the invention for adjusting the inter-car distance in an elevator comprising two or more elevator cars mounted in a common car frame, which is supported and movable by means of a set of hoisting ropes, the vertical distance between the elevator cars is adjusted by moving at least one of the elevator cars in relation to the car frame by pulling the elevator car to be moved upwards and lowering the elevator car to be moved downwards by means of at least one adjusting rope.

The elevator of the invention, which comprises two or more elevator cars coupled to each other to be movable together in an elevator shaft, and in which these elevator cars are at least partly suspended by a common set of hoisting ropes. The elevator has at least one separate adjusting rope and diverting pulleys arranged in a loop formed by the adjusting rope, the length of which loop can be varied by means of a separate mechanism acting on the adjusting rope. In the elevator, the upper one of the diverting pulleys is movable with the movement of the upper elevator car, while the lower one of the diverting pulleys is movable with the movement of the lower elevator car. Another elevator according to the invention comprises two or more elevator cars mounted in a common car frame, which is suspended and movable by a set of hoisting ropes. The elevator comprises at least one separate adjusting rope and diverting pulleys. In the elevator, at least one of the elevator cars is suspended in the car frame and supported by the at least one adjusting rope and diverting pulleys.

BRIEF DESCRIPTION OF THE DRAWINGS

In the following, the invention will be described in detail with reference to an embodiment example and the attached drawings, wherein.

DETAILED DESCRIPTION OF THE INVENTION

Figure 1:
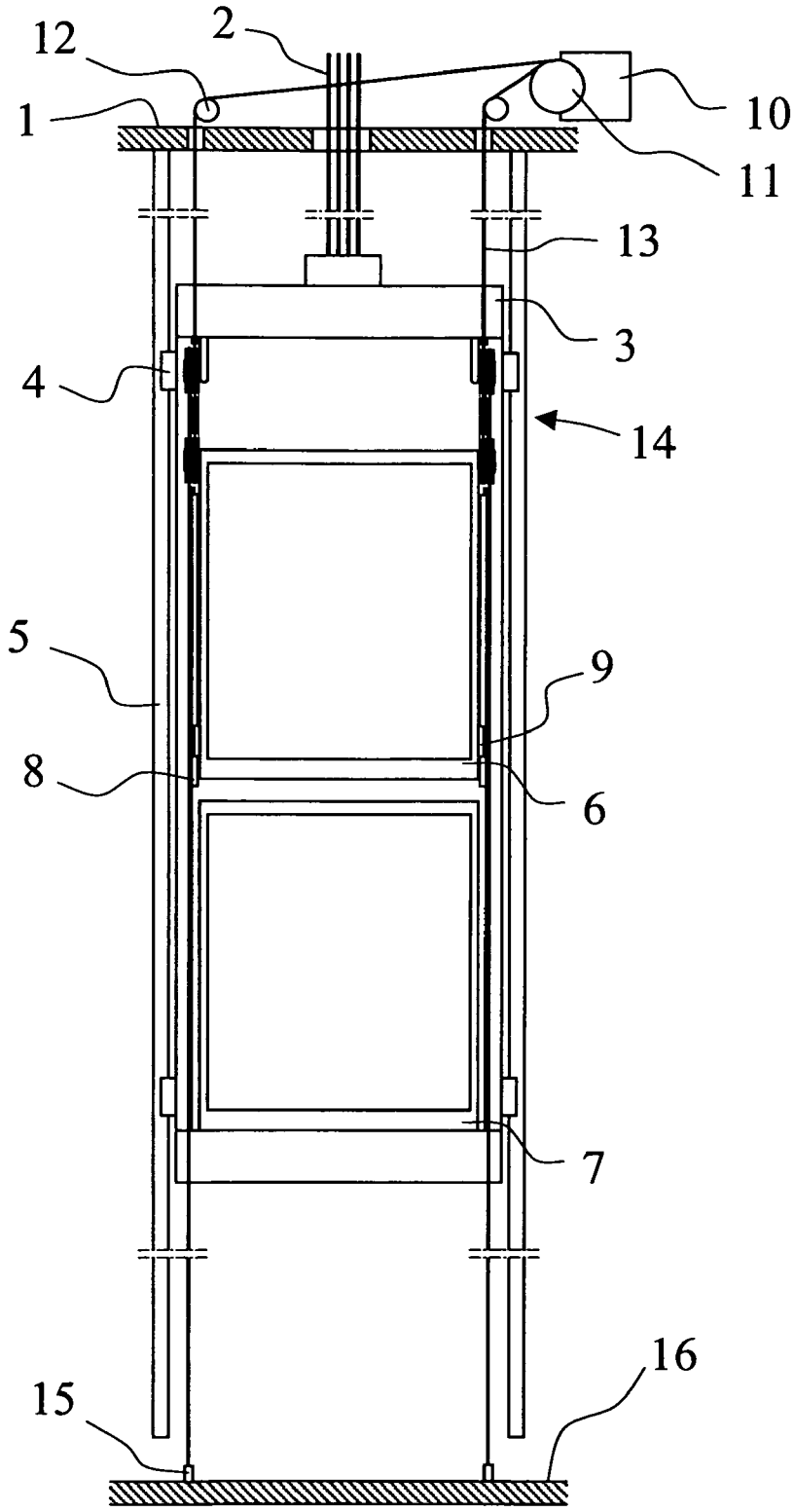
FIG. 1 presents a simplified front view of a double-deck elevator solution applying the invention.

FIG. 1 presents a typical double-deck elevator solution applying the invention, comprising a machine room 1 and below it an elevator shaft with a car frame 3 moving in it along vertical guide rails 5, the car frame being guided by guides 4 and suspended and moved vertically in the elevator shaft with main hoisting ropes 2 by means of an elevator machine not shown in the figure. Placed in the car frame 3 are an upper elevator car 6 and a lower elevator car 7, which are independent of each other and spaced by a vertical distance between them. The lower elevator car 7 is fixedly mounted in the car frame 3 and therefore only moves with the car frame 3, whereas the upper elevator car 6 has been arranged to move along vertical guide rails 8 placed at the inner edge of the car frame 3, with guides 9 guiding the car. The upper elevator car 6 is suspended from the top cross member of the car frame 3 by means of separate adjusting ropes 13 and a set of adjusting wheels 14 in such manner that the upper elevator car 6 can be moved vertically in relation to the car frame 3 and the lower elevator car 7 by an adjusting mechanism 10. The adjusting mechanism 10 is placed in the elevator machine room 1 and the adjusting mechanism comprises at least a rope drum 11 and diverting pulleys 12 disposed in the machine room 1 to guide the adjusting ropes 13. The adjusting mechanism 10 is controlled via the elevator control system. The first end of the adjusting ropes is on the rope drum 11 and the second end is secured to fixing point 15 on the bottom 16 of the elevator shaft.

Figure 2:
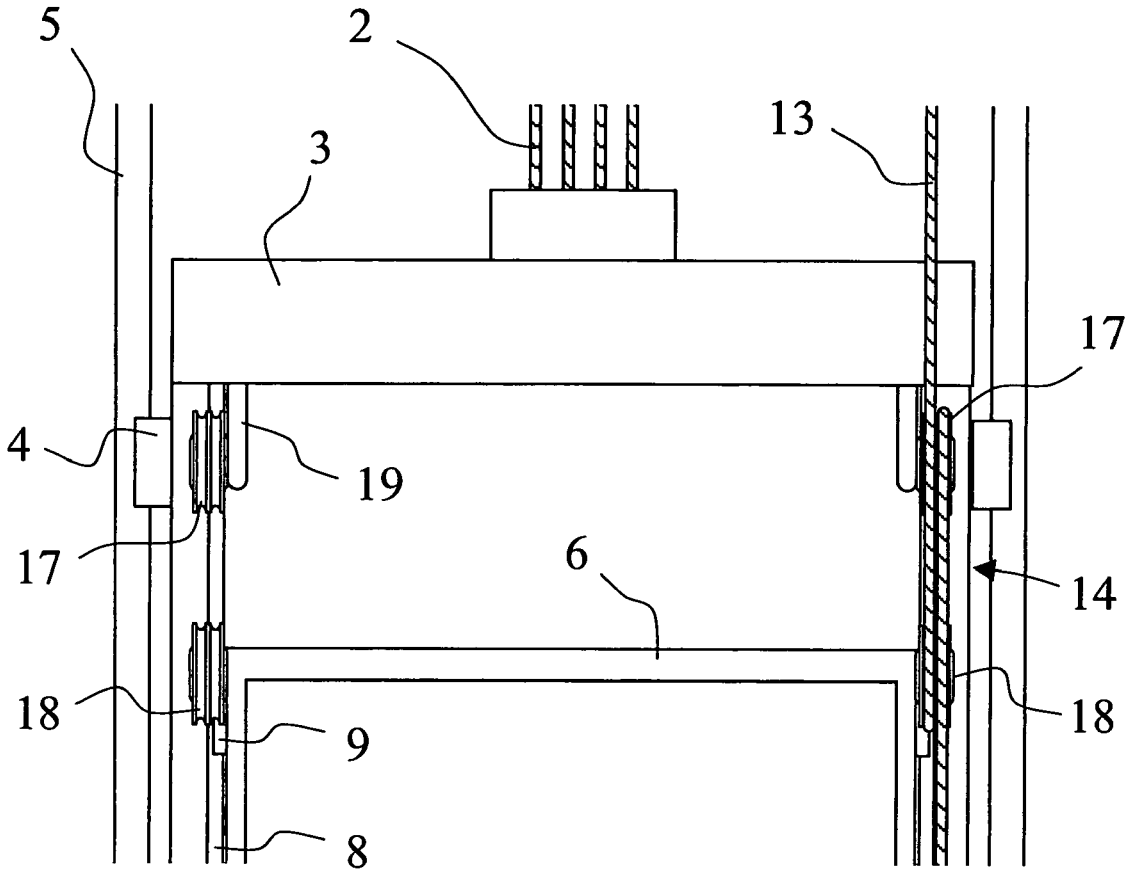
FIG. 2 presents a magnified and simplified front view of a detail at the upper end of the car frame in the solution illustrated in FIG. 1.
Figure 3:
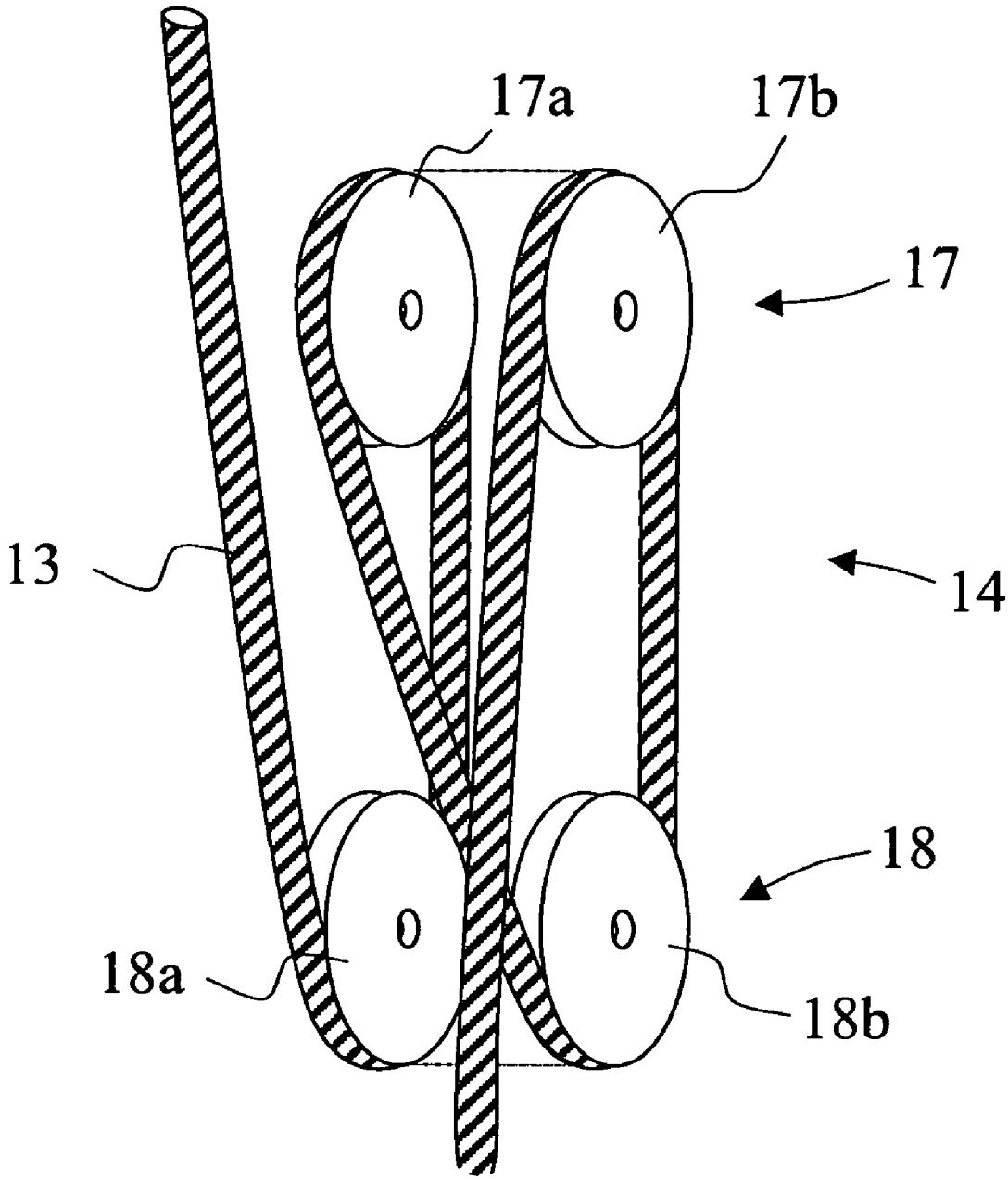
FIG. 3 presents a simplified diagram of a rope arrangement according to the invention for adjustment of the inter-car distance.

FIGS. 2 and 3 give a more detailed illustration of the suspension of the upper elevator car 6 and the set of adjusting wheels 14 according to the invention. The top cross member of the car frame 3 is provided with brackets 19 on which the upper diverting pulleys 17 comprised in the set of adjusting wheels are pivoted, one on either side of the car frame. Correspondingly, the lower diverting pulleys 18 of the set of adjusting wheels are pivoted in the upper part of the upper elevator car 6 substantially directly below the upper diverting pulleys 17 of the set of adjusting wheels. The adjusting rope 13 of the left-hand set of adjusting wheels has been omitted from FIG. 2 for clarity.

The passage of the adjusting rope 13 can be seen best from FIG. 3. Here, for the sake of clarity, the two double-grooved diverting pulleys 17, 18 are presented as two parallel pulleys or grooves 17*a*, 1*b* and 18*a*, 18*b*, although it is actually also possible to use two single-grooved pulleys placed side by side. By following the passage of the adjusting rope 13 from above downwards, one can see that the adjusting rope first comes down from the drum 11 of the adjusting mechanism to the first groove 18*a* of the lower diverting pulley 18, passes under and around the diverting pulley and goes to the first groove 17*a* of the upper diverting pulley 17. Having passed over and around the upper diverting pulley 17 for the first time, the adjusting rope comes again downwards to the lower diverting pulley 18, but this time in an oblique direction, and passes under and around the lower diverting pulley for a second time, now along groove 18*b*. After this, the adjusting rope 13 goes upwards to the second groove 17*b* of the upper diverting pulley 17 and passes over and around the upper diverting pulley 17 for a second time, whereupon the adjusting rope 13 goes down to its fixing point 15 on the bottom 16 of the shaft.

When the car frame 3 suspended by the hoisting ropes 2 is moving vertically, the adjusting rope 13 runs at the same rate in the set of adjusting wheels 14 around the diverting pulleys 17 and 18 and the upper elevator car 6 remains stationary in relation to the car frame 3. When the upper car is to be raised or lowered in relation to the car frame or the lower car 7 by means of the adjusting mechanism 10, the adjusting rope 13 is pulled upwards or lowered downwards as necessary. The car frame 3 and the lower elevator car 7 now remain stationary, but the upper elevator car 6 is moving in the vertical direction. When the adjusting rope 13 is pulled upwards in the direction of the adjusting mechanism 10, the loop of the adjusting rope 13 over the diverting pulleys 17 and 18 in the set of adjusting wheels 14 is tightened and the vertical distance between the diverting pulleys is reduced. Thus, the upper elevator car 6 rises and the inter-car distance increases. Correspondingly, when the adjusting rope 13 is delivered downwards in the direction away from the adjusting mechanism 10, the loop of the adjusting rope 13 over the diverting pulleys 17 and 18 in the set of adjusting wheels 14 is slackened and the vertical distance between the diverting pulleys 17 and 18 is increased. Thus, the upper elevator car 6 is lowered and the inter-car distance decreases.

By the method of the invention, the adjustment of the vertical distance between the elevator cars is thus accomplished by moving the upper elevator car 6 in the vertical direction by means of the adjusting rope 13 either by pulling the adjusting rope 13 upwards or by lowering it downwards.

Figure 4:
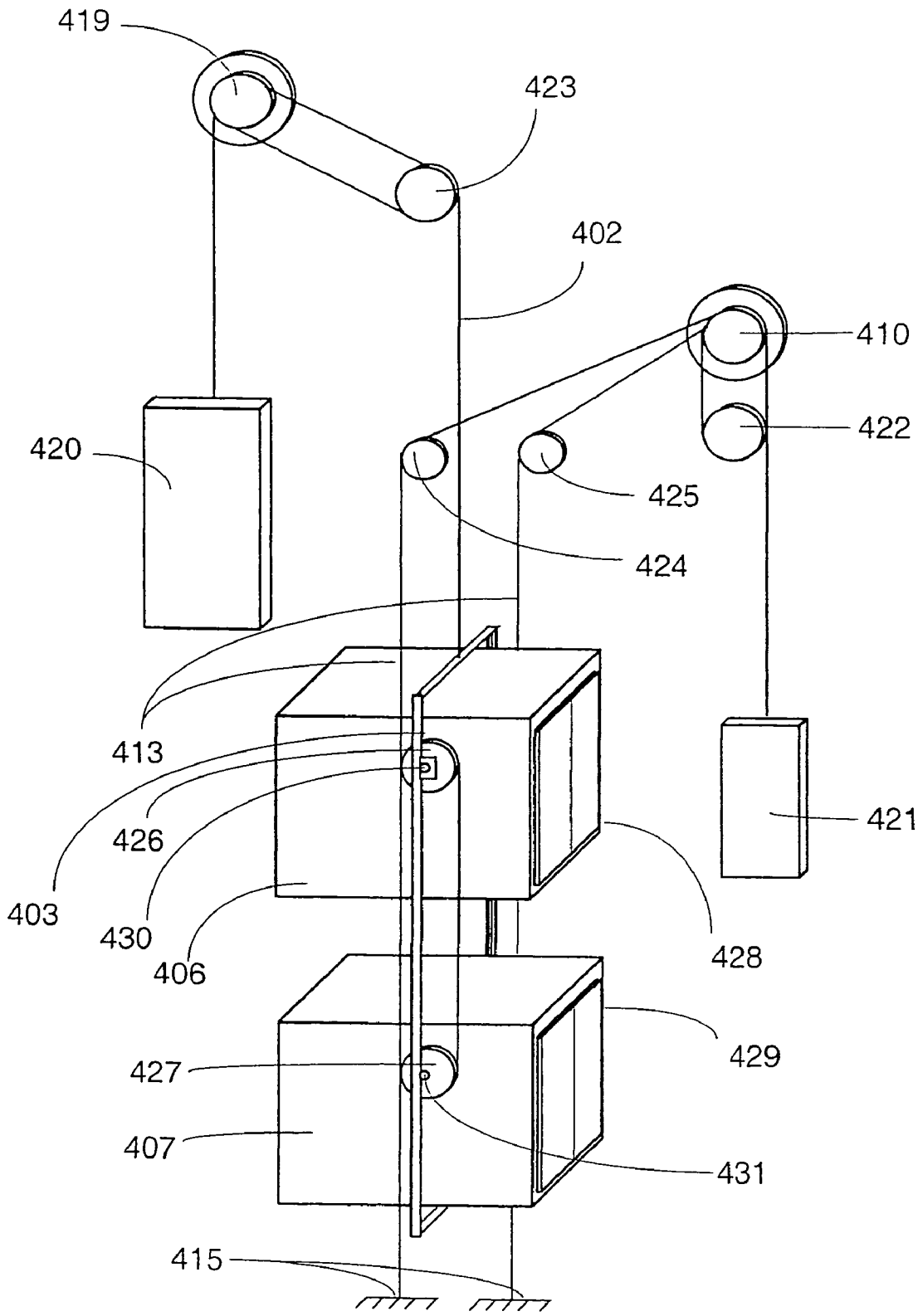
FIG. 4 presents a double-deck elevator solution according to the invention wherein the car distance adjusting mechanism has been implemented using frictional drive.

FIG. 4 presents an elevator according to the invention in which the adjustment of the vertical distance between the elevator cars has been implemented using an adjusting mechanism based on frictional drive, wherein a counterweight is fitted at one end of the adjusting ropes while the other end of the adjusting ropes is secured to the bottom of the elevator shaft or to some other appropriate place in the elevator shaft. FIG. 4 shows the main hoisting machine 419 of the elevator, which may be installed in an elevator machine room or in the elevator shaft or in some other appropriate place. A car frame 403 guided in the elevator shaft by guide rails and guides (not shown in the figure) appropriate for the purpose, and suspended by main hoisting ropes 402 is driven by the main hoisting machine. Secured to one end of the main hoisting ropes 402 is a counterweight 420. The main hoisting machine presented is a hoisting machine implemented using Double Wrap (DW) roping, wherein the main hoisting ropes 402 coming from the counterweight 420 to the traction sheave of the main hoisting machine 419 pass around it along rope grooves provided in the traction sheave and go further to a diverting pulley 423, and having passed around this pulley the hoisting rope 402 returns back to the traction sheave of the hoisting machine 419. The hoisting rope passes a second time around the traction sheave along rope grooves and goes further over the diverting pulley 423 to the car frame 403 of the elevator, the other end of the main hoisting ropes being secured to the car frame. The use of DW roping provides a better grip on the traction sheave of the main hoisting machine as it increases the contact angle between the traction sheave and the hoisting rope 402, this angle being 360° in FIG. 4. The suspension arrangement of the elevator of the invention can also be implemented in other ways, such as e.g. by using Single Wrap roping or Extended Single Wrap roping or some other roping arrangement appropriate for the purpose.

Mounted in the car frame 403 are an upper elevator car 406 and lower elevator car 407, which are disposed at a vertical distance from each other. The upper elevator car 406 in FIG. 4 is immovably mounted in the car frame 403 and thus, in the case of FIG. 4, it only moves with the car frame, whereas the lower elevator car 407 has been fitted to move vertically along vertical guide rails provided in the car frame 403, guided by its own guides. The lower elevator car 407 is suspended in the car frame 403 and/or from elevator car 406 by means of separate adjusting ropes 413 and adjusting pulleys 426, 427, 428, 429 so that the lower elevator car 407 can be moved in relation to the car frame 403 and the upper car 406 by an adjusting mechanism 410. The adjusting mechanism 410 is placed in an elevator machine room, in the elevator shaft or in some other suitable place in the building. The adjusting mechanism 410 is implemented using an elevator machine based on frictional drive, wherein a traction sheave comprised in the adjusting mechanism 410 drives the adjusting ropes, to the first end of which is attached a counterweight 421 while the second end of the adjusting ropes 413 is secured to the floor of the elevator shaft or to some other appropriate place in the elevator shaft. FIG. 4 presents an adjusting mechanism 410 provided with a DW roping arrangement, which improves the grip between the adjusting ropes 413 and the traction sheave of the adjusting mechanism 410. The DW roping is implemented using a diverting pulley 422. The adjustment of the vertical distance between the elevator cars 406 and 407 is implemented as desired in connection with FIGS. 1, 2 and 3, with the difference that in FIG. 4 the lower elevator car 407 is moved and that the adjusting wheels may be mounted in several different parts of the car frame 403 that are suited for the purpose. In the elevator of the invention, the counterweights 420, 421 and their guide rails can be disposed on one side of the elevator cars 406, 407 and/or the car frame 403 if necessary.

The elevator and the method of the invention for adjusting the inter-car distance of an elevator can also be implemented in a system comprising more cars than in the examples illustrated in the figures. For example, it is possible to implement elevators comprising several elevator cars mounted in a common car frame, at least one which cars is moved vertically in relation to the other cars. It is possible to implement e.g. elevators having 3 or even mover elevator cars. In addition, it is possible to implement elevators in which two or more elevator cars are coupled to each other in a way other than by a car frame, and in which these elevator cars are at least partly suspended by a common set of hoisting ropes.

It is obvious to the person skilled in the art that different embodiments of the invention are not limited to the example described above, but that they may be varied within the scope of the claims presented below. Thus, to change the distance between the elevator cars in the car frame 3, it is also possible to use other adjusting mechanisms than that described above. For example, the adjusting ropes 13 can also be pulled upwards and lowered downwards by means of hydraulic cylinders or corresponding power cylinders, as well as by means of screw mechanisms, because the adjustment distance is not long.

It is likewise obvious to the skilled person that the adjusting mechanism may be disposed in the lower part of the shaft, in which case the second ends of the adjusting ropes 13 are fastened to the top of the elevator shaft. In addition, the rope suspension of the set of adjusting wheels 14 may differ from the above description in respect of the number of diverting pulleys or grooves and the number of times the adjusting rope is passed around the diverting pulleys.

It is also obvious to the person skilled in the art that, instead of the upper elevator car 6, the lower elevator car 7 may be adjustable in the manner described above by means of adjusting ropes 13, in which case the upper elevator car 6 is correspondingly mounted to be immovable with respect to the car frame 3.

It is obvious to the skilled person that the adjustment of a double-deck elevator disclosed by the invention can also be implemented using an elevator machine implemented with frictional drive and without counterweight. In this case, the suspension ratio of the elevator cars can be increased both in the hoisting rope portion above the elevator car and in the hoisting rope portion below the elevator car. For example, the elevator cars can be suspended with a suspension ratio 4:1, 5:1, 6:1, 7:1, 8:1 of the hoisting rope portion above and/or below the elevator car the elevator cars or even with a higher suspension ratio. The adjusting ropes used in the adjusting mechanism to move the elevator cars may also be thin ropes and/or strong ropes or belts or other hoisting ropes suited for the purpose. It is also obvious to the skilled person that the dimension of the car frame in the vertical direction may vary, e.g. in such manner that the adjustment distance between the elevator cars in the car frame may equal several inter-floor distances and meters, in which case the distance through which the main hoisting machine has to move the car frame is correspondingly shorter, and that it is possible to move several elevator cars in the car frame in relation to each other and the car frame.

The invention claimed is:

1. A method for adjusting the vertical inter-car distance in an elevator which comprises two or more elevator cars coupled to each other to be movable together in an elevator shaft and in which these elevator cars are at least partly suspended by a common set of hoisting ropes, characterized in that the vertical inter-car distance between the elevator cars is adjusted by moving at least one of the elevator cars in relation to at least one other elevator car by pulling and lowering the at least one elevator car to be moved by means of at least one adjusting rope said adjusting rope being moved by an adjusting mechanism located on a non-moving structure of the elevator shaft, at least one end of said adjusting rope being secured so as to be substantially immovable relative to the elevator shaft.

2. A method for adjusting the vertical inter-car distance in an elevator comprising two or more elevator cars placed in a common car frame suspended and movable by means of a set of hoisting ropes, characterized in that the vertical inter-car distance between the elevator cars is adjusted by moving at least one of the elevator cars in relation to the car frame by pulling and lowering the at least one elevator car to be moved by means of at least one adjusting rope said adjusting rope being moved by an adjusting mechanism located off of said car frame, at least one end of said adjusting rope being secured so as to be substantially immovable relative to the elevator shaft.

3. A method according to claim 1, characterized in that a counterweight is suspended from the adjusting rope to tension the adjusting rope.

4. A method according to claim 1, characterized in that at least another end of at least one adjusting rope is secured to an adjusting mechanism, which adjusting mechanism pulls the adjusting rope in a direction towards itself and delivers the adjusting rope in a direction away from itself.

5. A method according to claim 1, characterized in that the vertical inter-car distance between the elevator cars is adjusted by moving at least one of the elevator cars in the vertical direction by means of the adjusting rope, which adjusting rope has been arranged to pass at least once around a diverting pulley connected to the elevator car to be moved and at least once around a diverting pulley connected to the car frame.

6. A method according to claim 1, characterized in that the vertical inter-car distance between the elevator cars is adjusted by moving an upper elevator car in the vertical direction by means of the adjusting rope, which adjusting rope has been arranged to pass at least once around a diverting pulley connected to the upper elevator car and at least once around a diverting pulley connected to the car frame.

7. A method according to claim 1, characterized in that the vertical inter-car distance between the elevator cars is adjusted by moving the upper elevator car in the vertical direction by means of the adjusting rope, which adjusting rope has been arranged to pass at least twice around a coaxial pair of diverting pulleys connected to an upper elevator car and at least twice around a coaxial pair of diverting pulleys connected to the car frame during its course between its fixing points.

8. An elevator which comprises two or more elevator cars coupled to each other so as to be movable together in an elevator shaft and in which these elevator cars are at least partly suspended by a common set of hoisting ropes, characterized in that the elevator has at least one separate adjusting rope and diverting pulleys arranged in a loop formed by the adjusting rope, the length of which loop can be varied by means of a separate mechanism acting on the adjusting rope, and that an upper one of the diverting pulleys is movable with the movement of an upper elevator car while a lower one of the diverting pulleys is fixed to the lower elevator car, said separate mechanism being located on a non-moving structure of said elevator shaft.

9. An elevator according to claim 8, characterized in that the car frame is provided with at least one of the diverting pulleys and another one of the elevator cars is provided with at least one of the diverting pulleys, around which diverting pulleys the adjusting rope is passed at least once during its course between its fixing points.

10. An elevator according to claim 8, characterized in that the car frame is provided with at least one of the diverting pulleys and the upper elevator car is provided with at least another one of the diverting pulleys, around which diverting pulleys the adjusting rope is passed at least once.

11. An elevator according to claim 8, characterized in that the apparatus comprises an adjusting mechanism, to which the first end of the adjusting rope is secured and which adjusting mechanism has been arranged to pull the adjusting rope in a direction towards itself and to deliver the adjusting rope in a direction away from itself, and that the adjusting rope has been passed around the diverting pulleys in such manner that, when the adjusting mechanism is pulling the adjusting rope in the direction towards itself, the vertical distance between the diverting pulleys decreases, and when the adjusting mechanism is delivering the adjusting rope in the direction away from itself, the vertical distance between the diverting pulleys increases.

12. An elevator according to claim 8, characterized in that the adjusting rope is passed at least twice around coaxial pairs of the diverting pulleys during its course between its fixing points.

13. An elevator according to claim 8, characterized in that an adjusting mechanism comprises a rope drum to which the first end of the adjusting rope has been secured, and that at least part of the adjusting mechanism is disposed in the elevator machine room, the second end of the adjusting rope being secured to the floor of the elevator shaft.

14. An elevator according to claim 8, characterized in that the actuation of the adjusting rope has been implemented using frictional drive.

15. An elevator according to claim 14, characterized in that the first end of the adjusting rope is secured to the counterweight and the second end of the adjusting rope is immovably secured to the elevator shaft.

16. An elevator which comprises two or more elevator cars mounted in a common car frame suspended and movable by a set of hoisting ropes, characterized in that the elevator comprises at least one separate adjusting rope and diverting pulleys, and at least one of the elevator cars is suspended in the car frame and supported by the at least one adjusting rope and the diverting pulleys, said adjusting rope being moved by an adjusting mechanism located off of the car frame, at least one end of said adjusting rope being secured so as to be substantially immovable relative to the elevator shaft.

* * * * *